US005881957A

United States Patent [19]

Mizuno et al.

[11] Patent Number: 5,881,957

[45] Date of Patent: Mar. 16, 1999

[54] NOZZLE STRUCTURE OF FUEL INJECTOR FOR INTERNAL COMBUSTION ENGINE

[75] Inventors: Yoshinori Mizuno, Takahama; Yoshimi Ogihara, Toyohashi; Hideo Kiuchi, Aichi-ken; Masaki Funahashi, Kariya, all of Japan

[73] Assignee: Denso Corporation, Kariya, Japan

[21] Appl. No.: 824,720

[22] Filed: Mar. 26, 1997

[30] Foreign Application Priority Data

Mar. 26, 1996 [JP] Japan ..... 8-69906
Feb. 14, 1997 [JP] Japan ..... 9-30401

[51] Int. Cl.[6] ..... B05B 1/00; F02M 61/20

[52] U.S. Cl. ..... 239/533.2; 239/533.9; 239/533.12; 239/533.14; 239/596

[58] Field of Search ..... 239/533.1, 533.2, 239/533.3, 533.9, 533.12, 533.14, 596

[56] References Cited

U.S. PATENT DOCUMENTS

| | | | |
|---|---|---|---|
| 1,657,372 | 1/1928 | Danielsson | 239/596 X |
| 5,244,154 | 9/1993 | Buchholz et al. | 239/596 X |
| 5,273,215 | 12/1993 | Hans et al. | 239/533.12 X |
| 5,323,966 | 6/1994 | Buchholz et al. | 239/533.12 X |
| 5,586,726 | 12/1996 | Furuya et al. | 239/533.12 |
| 5,636,796 | 6/1997 | Oguma | 239/596 X |

FOREIGN PATENT DOCUMENTS

| | | | |
|---|---|---|---|
| 5-501748 | 4/1993 | Japan . | |
| 5-187341 | 7/1993 | Japan . | |
| 6-026419 | 2/1994 | Japan . | |
| 6-501087 | 2/1994 | Japan . | |
| 2225809 | 6/1990 | United Kingdom | 239/533.12 |

*Primary Examiner*—Andres Kashnikow
*Assistant Examiner*—Robin O. Evans
*Attorney, Agent, or Firm*—Pillsbury Madison & Sutro LLP

[57] ABSTRACT

A fuel injector for an internal combustion engine is provided which includes a valve body, a needle valve, and a hollow nozzle body with a bottom having formed therein spray holes.

The needle valve is controlled to be selectively brought into and out of engagement with a valve seat in the valve body to close and open a fuel outlet formed in an end surface of the valve body. The hollow nozzle body is welded to the valve body with the bottom urged into constant engagement with the end surface of the valve body at a given level of pressure which is greater than a maximum fuel injection pressure. This makes it possible to establish the constant engagement of the bottom of the hollow nozzle body with the end surface of the valve body without any clearances even when the maximum fuel injection pressure acts on a portion of the bottom of the hollow nozzle body around the spray holes.

10 Claims, 8 Drawing Sheets

NOZZLE STRUCTURE OF FUEL INJECTOR FOR INTERNAL COMBUSTION ENGINE

BACKGROUND OF THE INVENTION

1. Technical Field

The present invention relates generally to a fuel injector for internal combustion engines, and more particularly to an improved nozzle structure of a fuel injector designed for establishing fine atomization of fuel.

2. Background of Related Art

In recent years, the exhaust emission regulation of automotive vehicles has been tightened, requiring fine atomization of fuel to be injected into the engine. In order to meet this requirement, there have been proposed some fuel atomization mechanisms including a nozzle plate which is disposed downstream of a valve seat formed in a valve body and which has formed therein spray holes designed to be suitable for atomization of fuel spray.

FIGS. 11 and 12 show one example of conventional fuel injectors. The shown fuel injector is designed to move a valve head 125*a* formed on an end of a needle 125 into and out of engagement with a valve seat 126*a* formed in a valve body 126 for closing and opening a fuel nozzle. The fuel injector includes a nozzle disc 130 attached to an end 126*b* of the valve body 126. The nozzle disc 130 has formed therein four spray holes 130*a*, as shown in FIG. 12, for atomization of fuel sprays.

The above fuel injector, however, has the drawback in that the nozzle disc 130 is made of a thin plate and, therefore, the fuel injection pressure causes the nozzle disc 130 to be deformed outward, thereby leading to the formation of an air gap between an inner surface 130*b* of the nozzle disc 130 and the end 126*b* of the valve body 126. This will cause the fuel to enter the air gap partly, resulting in change in spread of fuel sprays and decrease in amount of the fuel injected.

In order to avoid the above problems, it may be proposed to increase the thickness of the nozzle disc 130, however, the increase in thickness more than 1 mm will cause the depth of the spray holes 130*a* in a direction of the fuel injection to be increased undesirably, thereby leading to the accumulation of fuel in the spray holes 130*a*, which, like the above, results in change in spread of fuel sprays and decrease in amount of the fuel injected.

The nozzle disc 130 is, as shown in FIG. 11, welded at locations 191 to the end 126*b* of the nozzle body 126 and, therefore, the welding heat is transmitted directly to the nozzle body, which may result in thermal deformation of the valve seat 126*a*, leading to the leakage of fuel into a combustion chamber of the engine even when the injector is fully closed. This will cause the amount of unburned hydrocarbon (HC) to be increased, leading to a greater concern about an increase in harmful emissions.

Japanese Patent First Publication No. 5-187341 discloses an improvement on a fuel injector for internal combustion engines, however, has the same problems set forth above.

International Publication Nos. WO92/03653 and WO93/02285 and Japanese Patent First Publication No. 6-26419 filed by the same applicant as that of the above publication No. 5-187341 propose measures for alleviating the above problem on the deformation of the nozzle disc 130.

Specifically, International Publication No. WO92/03653 and Japanese Patent First Publication No. 6-26419 teach a cup-shaped nozzle body having a greater rigidity instead of the nozzle disc 130. International Publication No. WO93/02285 discloses a support plate which urges a nozzle disc into constant engagement with an end surface of a valve body.

The cup-shaped nozzle plate, however, encounters the drawback in that it is welded directly to the nozzle body, resulting the thermal deformation of a valve body and a valve seat.

The structure as taught in Japanese Patent First Publication No. 6-26419 gives rise to an increase in number of parts and the thermal deformation similar to the above.

SUMMARY OF THE INVENTION

It is therefore a principal object of the present invention to avoid the disadvantages of the prior art.

It is another object of the present invention to provide an improved nozzle structure of a fuel injector for internal combustion engines which is capable of atomizing fuel finely regardless of fuel injection pressure.

According to one aspect of the present invention, there is provided a fuel injector for an internal combustion engine which comprises: (a) a valve body having a given length, including a fuel inlet and a fuel outlet, the fuel outlet being formed in an end surface of the valve body; (b) a valve member slidably disposed within the valve body, the valve member having a valve head which is selectively brought into and out of engagement with a valve seat formed in the valve body to close and open the fuel outlet; (c) and a hollow nozzle body including a bottom, the bottom having formed therein a spray hole communicating with the fuel outlet of the valve body, the hollow nozzle body being connected to the valve body to urge the bottom into constant engagement with the end surface of the valve body at a given level of pressure which is greater than a maximum fuel injection pressure.

In the preferred mode of the invention, the bottom of the hollow nozzle body is formed so as to have at least a portion curved outwardly which is pressed against the end surface of the valve body to be flat in constant engagement therewith to exert the given level of pressure on the end surface of the valve body.

A connecting member is further provided which is welded to a side wall of the hollow nozzle body to connect the hollow nozzle body to the valve body.

The connecting member is made of a sleeve having one end portion welded to an outer peripheral portion of the valve body and the other end portion welded to an outer surface of the side wall of the hollow nozzle body.

The valve body may include a hollow cylindrical extension projecting from a peripheral portion of the end surface of the valve body, into which the nozzle body is fitted with a side wall thereof welded to an inner wall of the hollow cylindrical extension.

The nozzle body may alternatively have a cylindrical side wall welded at an inner wall thereof to an outer peripheral wall of the valve body. The bottom of the nozzle body may partially project in an inward direction in constant engagement with the end surface of the valve body. It is advisable that the nozzle body be welded to the valve body so as to meet a relation of $L0>L1$ where $L0$ is a distance between the valve seat of the valve body and a location where the cylindrical side wall of the nozzle body is welded to the outer peripheral wall of the valve body and $L1$ is a distance between the valve seat of the valve body and a boundary between the outer peripheral wall and the end surface of the valve body.

The thickness of the hollow nozzle body is 1 mm or less.

According to another aspect of the invention, there is provided a method of manufacturing a fuel injector for an internal combustion engine which comprises the steps of: (a) providing a valve body which has slidably disposed therein a valve member, the valve member being selectively brought into and out of engagement with a valve seat formed in the valve body to close and open a fuel outlet formed in an end surface of the valve body; (b) welding a connecting member to the valve body; (c) pressing a hollow nozzle body at a bottom thereof against the end surface of the valve body so as to exert a given level of pressure greater than a maximum fuel injection pressure on the end surface of the valve body; and (d) welding the hollow nozzle body to the connecting member with the bottom of the hollow nozzle body urged to exert the given level of pressure on the end surface of the valve body.

In the preferred mode of the invention, the connecting member is made of a cylindrical member. In the first welding step, the connecting member is welded to an outer peripheral wall of the valve body from an outer wall of the connecting member, while in the second welding step, the hollow nozzle body is welded to an inner wall of the connecting member from an inner wall of the hollow nozzle body.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:

FIG. 1(*b*) is a partially perspective view as viewed from an arrow A in FIG. 1(*a*);

DESCRIPTION OF THE PREFERRED EMBODIMENT

Figure 1A:
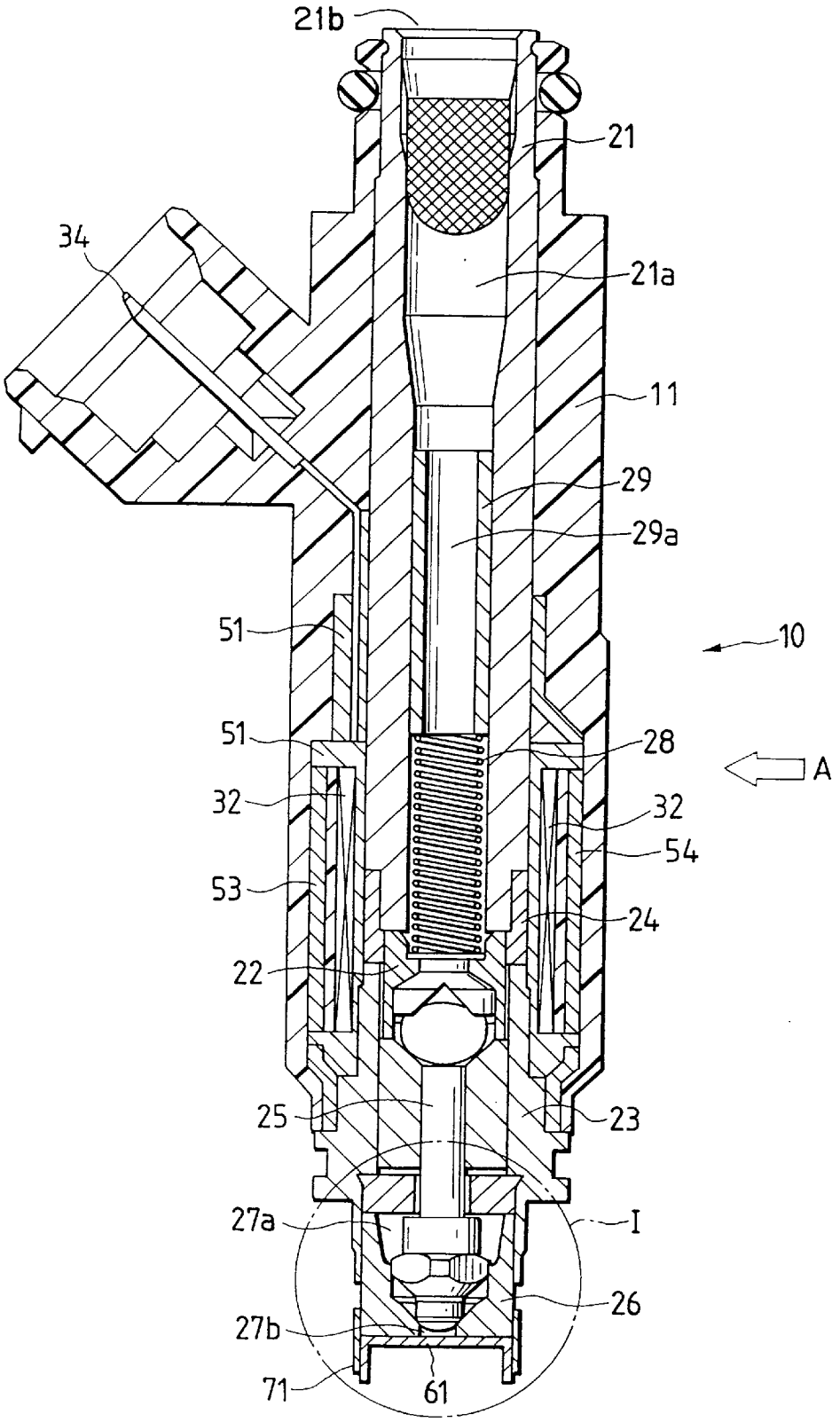
FIG. 1(*a*) is a longitudinal cross sectional view which shows a fuel injector for an internal combustion engine according to the first embodiment of the invention.
Figure 1B:
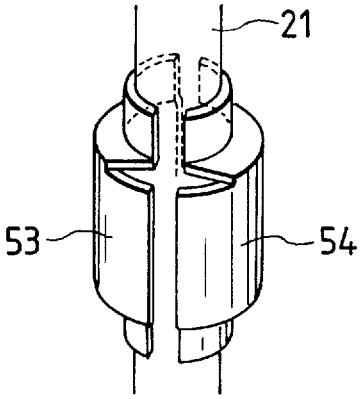

Referring now to the drawings, particularly to FIGS. 1(*a*) to 2, there is shown a fuel injector 10 for use in an internal combustion gasoline engine according to the present invention.

The fuel injector 10 includes a resinous casing 11 having disposed therein a stationary iron core 21, a spool 51, a solenoid 32, and a pair of metallic plates 53 and 54.

The iron core 21 is made of a ferromagnetic material and has formed therein a fuel passage 21*a* connected to a fuel pump (not shown) through a fuel inlet 21*b*. The iron core 21 has also disposed therein a pressure adjusting pipe 29 defining therein a fuel passage 29*a* communicating with the fuel passage 21*a*. The pressure adjusting pipe 29 is slidable within the iron core 21 in an axial direction of the fuel injector 10 and fixed at a desired location by means of a screw (not shown).

The fuel injector 10 also includes a magnetic pipe 23, a nonmagnetic pipe 24, a needle valve 25, a compression coil spring 28, and a movable iron core 22.

The non-magnetic pipe 24 is disposed between the magnetic pipe 23 and the iron core 21. The iron core 21, the non-magnetic pipe 24, and the magnetic pipe 23 are connected together by laser welding, for example.

The compression coil spring 28 is disposed between the adjusting pipe 29 and the needle valve 25 to urge the needle valve 25 at all times to close the fuel injector 10. The spring load acting on the needle valve 25 can be adjusted by the axial movement of the pressure adjusting pipe 29.

The movable iron core 22 is disposed slidably within the non-magnetic pipe 24 and the magnetic pipe 23. An end portion of the needle valve 25 is retained within the movable iron core 22 so that the movable iron core 22 is moved along with the needle valve 25.

The solenoid 32 is made of a coil of wire wound around the spool 51 and surrounds end portions of the iron core 21 and the magnetic pipe 23 and the whole of the non-magnetic pipe 24. The metallic plates 53 and 54 are, as clearly shown in FIG. 1(*b*), curved so as to cover the coil wound around the spool 51. Both ends of the coil of the solenoid 32 are connected to terminals 34 for supply of voltage to the solenoid 32.

When the solenoid 32 is energized, it will produce a magnetic flux through a magnetic path defined by the metallic plates 53 and 54, the stationary iron core 21, the movable iron core 22, and the magnetic pipe 23 to provide magnetic attraction drawing the movable iron core 22 to the stationary iron core 21 together with the needle valve 25. When the solenoid 32 is deenergized to remove the magnetic attraction, it will cause the movable iron core 22 to be urged away from the stationary iron core 21 by the spring force of the coil spring 28.

The fuel injector 10 also includes a valve body 26, a sleeve 71, and a cup-shaped nozzle body 61. The valve body 26 is, as clearly shown in FIG. 2, fitted into the end of the magnetic pipe 23 and has formed therein a fuel chamber 21*a* and a fuel outlet 21*b*. The fuel chamber 21*a* communicates with the fuel passage 29*a* of the pressure adjusting pipe 29 through a fuel passage (not shown).

The needle valve 25 includes a domed valve head 25*a* which is brought into and out of engagement with a conical valve seat 26*b* formed on an inner wall of the valve body 26 according to the axial movement of the needle valve 25 magnetically controlled by the solenoid 32 to close and open the fuel outlet 21*b*.

The sleeve 71 is secured on a peripheral wall of the valve body 26 by laser welding and retains the nozzle body 61 with press fit in contact of a bottom 61*a* with an end surface 26*a* of the valve body 26. The nozzle body 61 has an outer diameter substantially equal to that of the valve body 26.

Figure 3:
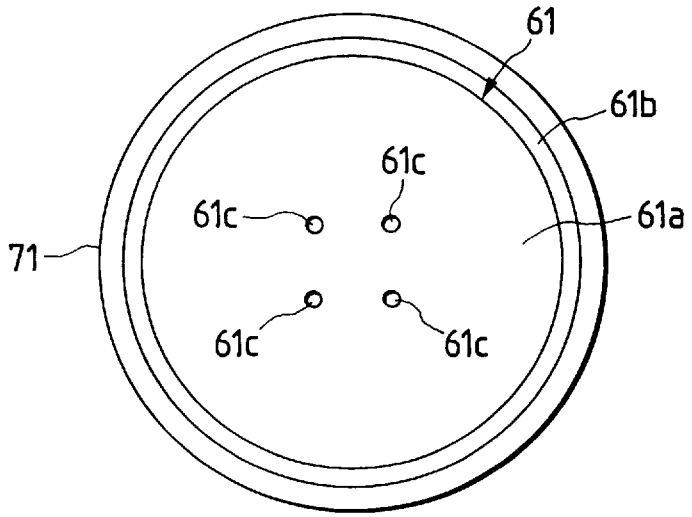
FIG. 3 is a bottom plan view which shows a bottom of a nozzle body of the fuel injector of FIG. 1.

The nozzle body 61 has the circular bottom 61*a* and the cylindrical side wall 61*b* and is made of, for example, a stainless steel (SUS304) having a thickness of 1 mm or less, preferably 0.2 mm to 0.3 mm. The nozzle body 61, as shown in FIG. 3, has formed in the bottom 61*a* four spray holes 61*c* having a diameter of 0.2 mm to 0.3 mm, communicating with the fuel outlet 21*b* of the valve body 26. The spray holes 61*c* are formed with a drill or an electric discharge machine, and the inner diameter thereof is then adjusted by bulging, as will be described later in detail, for spraying a desired amount of fuel.

The nozzle body 61 is made with a press, as will be described later, so that the bottom 61*a* projects outwardly 20 μm to 30 μm. Specifically, the bottom 61*a* is formed so as to have a dome-shape for producing the elasticity or reaction against the end surface 26*a* of the valve body 26 when the nozzle body 61 is forced into the sleeve 71 to urge the bottom 61*a* into constant engagement with the end surface 26*a* of the valve body 26. When pressed against the end surface 26*a* of the valve body 26 during installation of the nozzle body 61, the bottom 61*a* is depressed inwardly approximately 11 μm to produce a reaction force P1 of 7 kg against the end surface 26*a* of the valve body 26. A maximum fuel injection pressure P0 is usually 5.6 kg smaller than the reaction force P1 (P0<P1). Therefore, the reaction force P1 of the bottom 61*a* of the nozzle body 61 acting on the end surface 26*a* of the valve body 26 cancels part of the fuel injection pressure deforming the bottom 61*a* inward, thereby establishing constant surface engagement of the bottom 61*a* with the end surface 26*a* without any clearances therebetween during the fuel injection.

Figure 2:
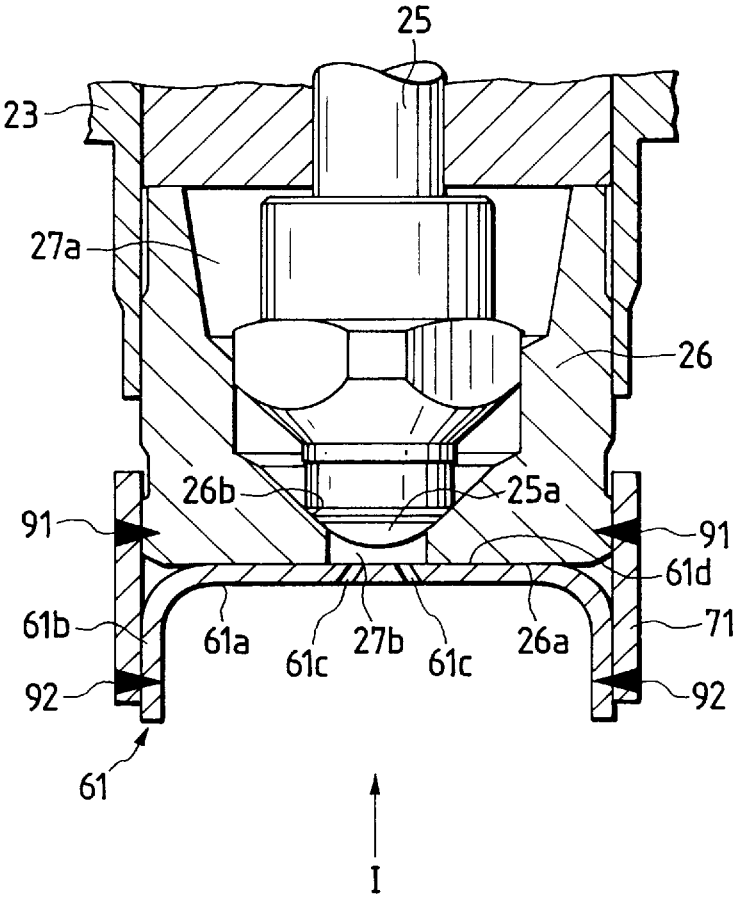
FIG. 2 is a partially enlarged view which shows a nozzle structure of the fuel injector of FIG. 1.
Figure 11:
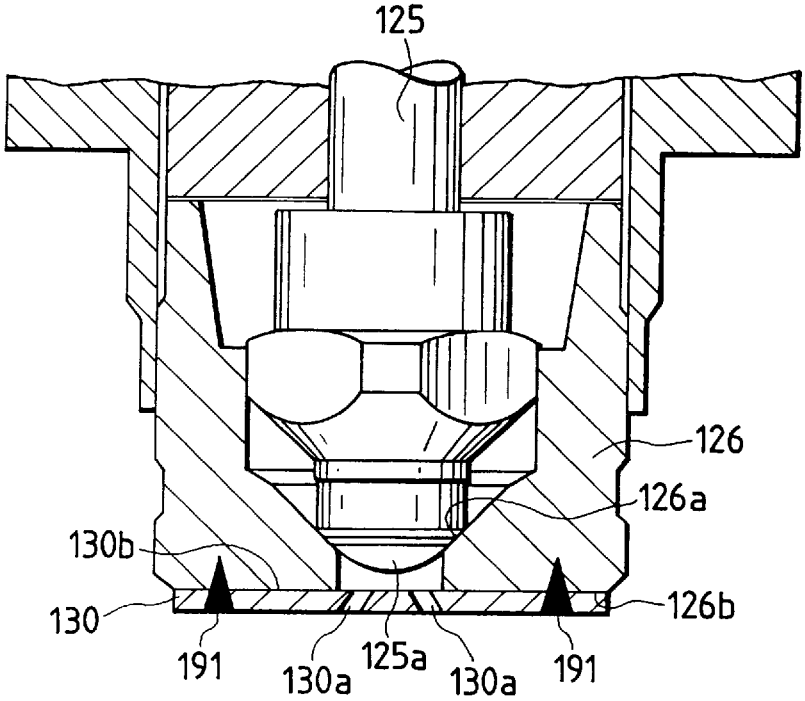
FIG. 11 PRIOR ART
FIG. 11 is a partially cross sectional view which shows a nozzle structure of a conventional fuel injector.
Figure 12:
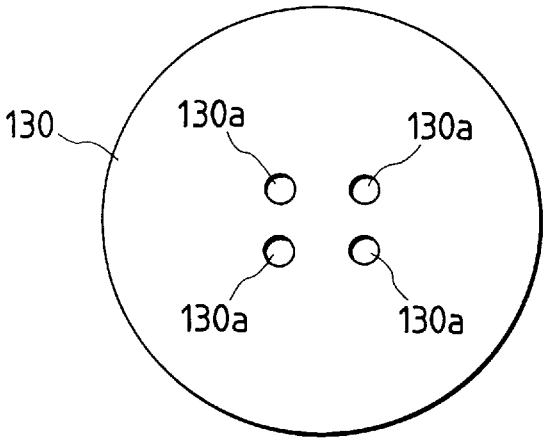
FIG. 12 PRIOR ART
FIG. 12 is a bottom plan view of FIG. 11.

The nozzle body 61 is, as clearly shown in FIG. 2, attached to an inner wall of the sleeve 71 by laser welding without being welded directly to the valve body 26. In practice, the sleeve 71 is first connected to the valve body 26 by laser welding at a portion 91 extending throughout the periphery thereof. Subsequently, the valve seat 26*b* is machined within the valve body 26. Finally, the nozzle body 61 is connected to the sleeve 71 by laser welding at a portion 92 extending throughout the periphery thereof. This prevents the heat produced upon laser welding of the nozzle body 61 to the sleeve 71 from being transmitted directly to the valve body 26, thus decreasing the amount of heat transmitted to the valve body 26 as compared with the conventional fuel injector as shown in FIG. 11 for minimizing thermal deformation of the valve seat 26*b*. Thus, liquid-tight engagement of the valve head 25*a* with the valve seat 26*b* is established when the fuel injector 10 is closed, thus avoiding the leakage of fuel spray into the engine.

Figure 4:
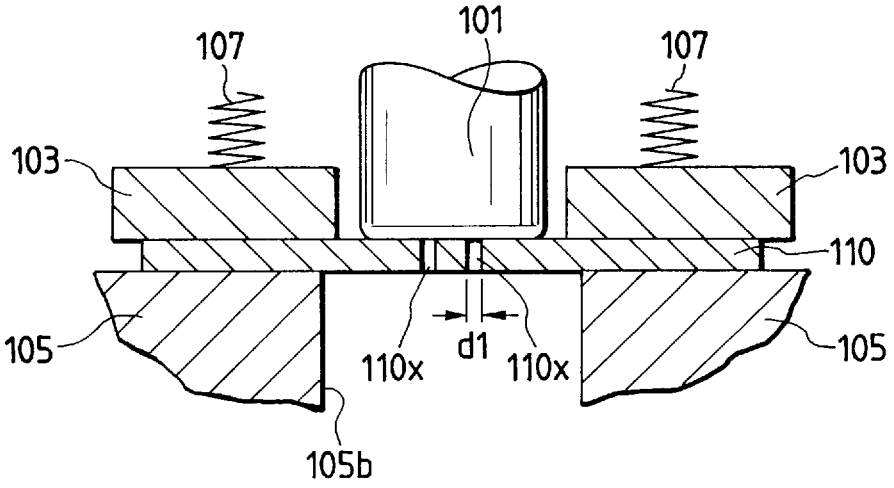
FIGS. 4 and 5 are cross sectional views which show a sequence of bulging steps to form a nozzle body.
Figure 5:
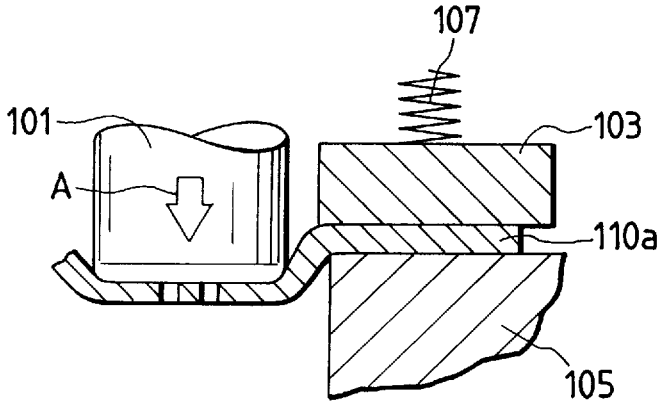
Figure 6A:
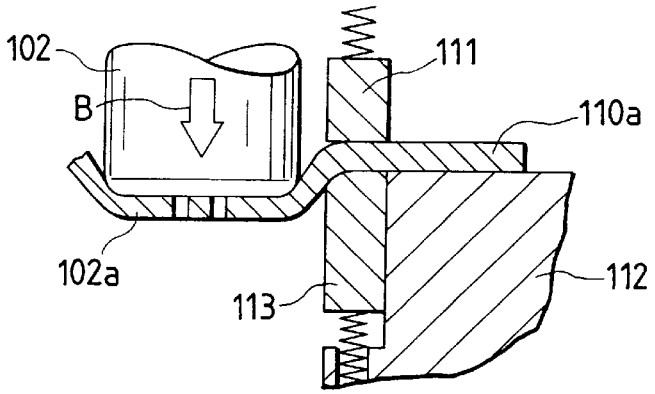
FIGS. 6(*a*) to 6(*c*) are cross sectional views which show a sequence of drawing steps following the bulging steps in FIGS. 4 and 5.
Figure 6B:
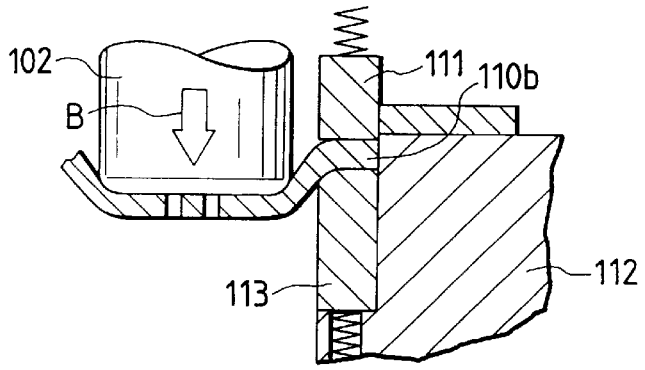
Figure 6C:
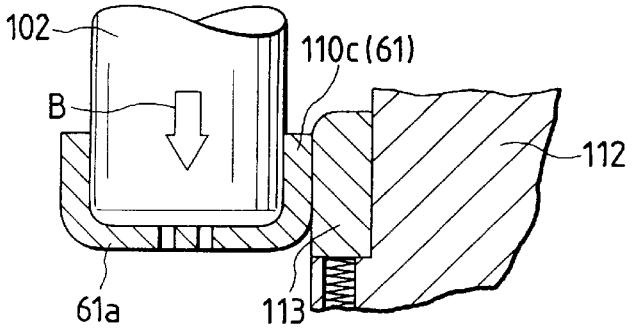

FIGS. 4 to 6(*c*) show a sequence of press operations to form the nozzle body 61.

The nozzle body 61 is formed by pressing a steel plate 110. The pressing involves bulging steps, as shown in FIGS. 4 and 5, and drawing steps, as shown in FIGS. 6(*a*) to 6(*c*).

BULGING

The steel plate 110 which has, as shown in FIG. 4, formed in its central portion four holes 110*x* each having an inner diameter of d1 is first placed on a press die 105 and clamped by a pressure plate 103 with aid of springs 107. A cylindrical punch 101 is, as shown by an arrow A in FIG. 5, pressed against the steel plate 110 to bulge a central portion of the steel plate 110 around the holes 110*x* to a given degree to form a hollow plate 110*a*.

DRAWING

After the bulging, the hollow plate 110*a* is, as shown in FIG. 6(*a*), placed on a stamping die 112 and clamped between a cylindrical drawing die 113 and a cylindrical pressure plate 111 which are spring-loaded. A cylindrical punch 102 which has a curved end surface 102*a* projecting outward approximately 20 μm to 30 μm is then pressed downward, as shown by an arrow B in FIG. 6(*a*), against the hollow plate 110*a*. The downward movement of the punch 102 causes the pressure plate 111 and the drawing die 113 to be moved, as shown in FIG. 6(*b*), downward together against the spring force, thereby sharing or cutting the periphery of the hollow plate 110*a* to form a hollow plate 110*b*. Then, the pressure plate 111 is, as shown in FIG. 6(*c*), lifted up to release the clamping of the hollow plate 110*b*. The punch 102 is further forced into the drawing die 113 to form a hollow cylinder 110*c* (i.e., the nozzle body 61) with the bottom 61*a* projecting outwardly approximately 20 μm to 30 μm.

The elastic deformation of the nozzle body 61 created when installed in the sleeve 71 will be discussed below.

Figure 7A:
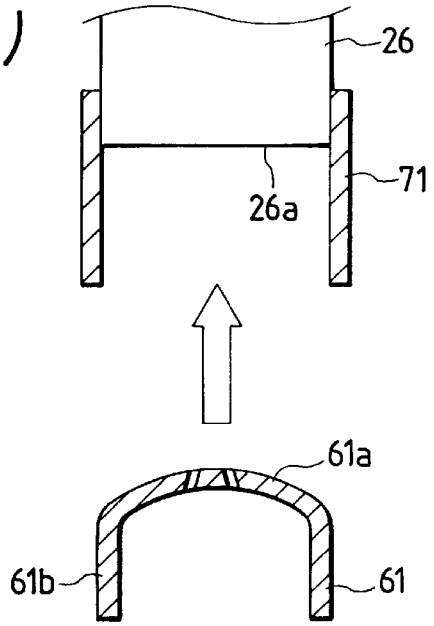
FIGS. 7(*a*) to 7(*c*) are cross sectional views which show a sequence of installation steps to press-fit a nozzle body into a valve body.
Figure 7B:
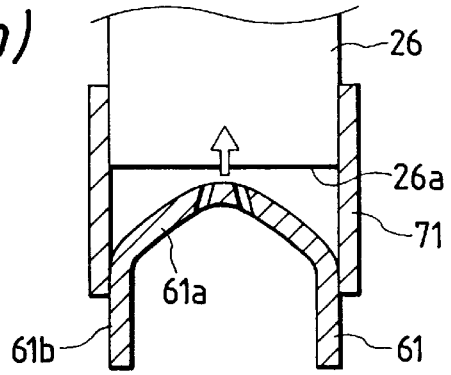
Figure 7C:
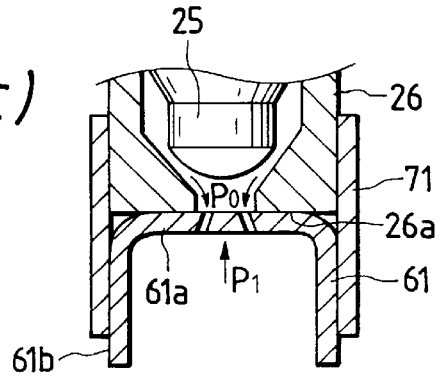

The sleeve 71 is, as shown in FIG. 7(*a*), welded to the outer wall of the valve body 26 prior to installation of the nozzle body 61 in the sleeve 71. The nozzle body 61 has an outer diameter slightly greater than an inner diameter of the sleeve 71 and is bulged, as already mentioned, at the bottom 61*a* outwardly.

In installation, the nozzle body 61 is, as shown in FIG. 7(*b*), first pressed into the sleeve 71. This causes the pressure to act on the side wall 61*b* of the nozzle body 61 to squeeze the side wall 61*b* inwardly, thereby further bulging the bottom 61*a* outwardly.

The nozzle body 61 is further inserted into the sleeve 71 from the position, as shown in FIG. 7(*b*), to bring the bottom 61*a* into engagement with the end surface 26*a* of the valve body 26. When the nozzle body 61 is further forced into the sleeve 71, it will cause the bottom 61*a* to be elastically deformed to be substantially flat, as shown in FIG. 7(*c*). The elastic deformation of the bottom 61*a* will produce the reaction force P1 acting on the end surface 26*a* of the valve body 26. Since the reaction force P1 is, as described above, greater than the maximum fuel injection pressure P0, the bottom 61*a* of the nozzle body 61 is maintained in surface contact with the end surface 26*a* of the valve body 26 without being deformed inward by the fuel pressure during fuel injection.

The diameter d1 of the holes 110*x* (i.e., the spray holes 61*c*) may be changed by modifying the clamping pressure during the bulging and the beat pressure exerted by the punch 102 and cushion pressure acting on the plate (110*a*, 110*b*, 110*c*) in the direction opposite the punch pressure during the drawing without replacement of the punches, the pressure plates, and the dies. This decreases the number of machining processes, resulting in a decrease in manufacturing cost.

Figure 8:
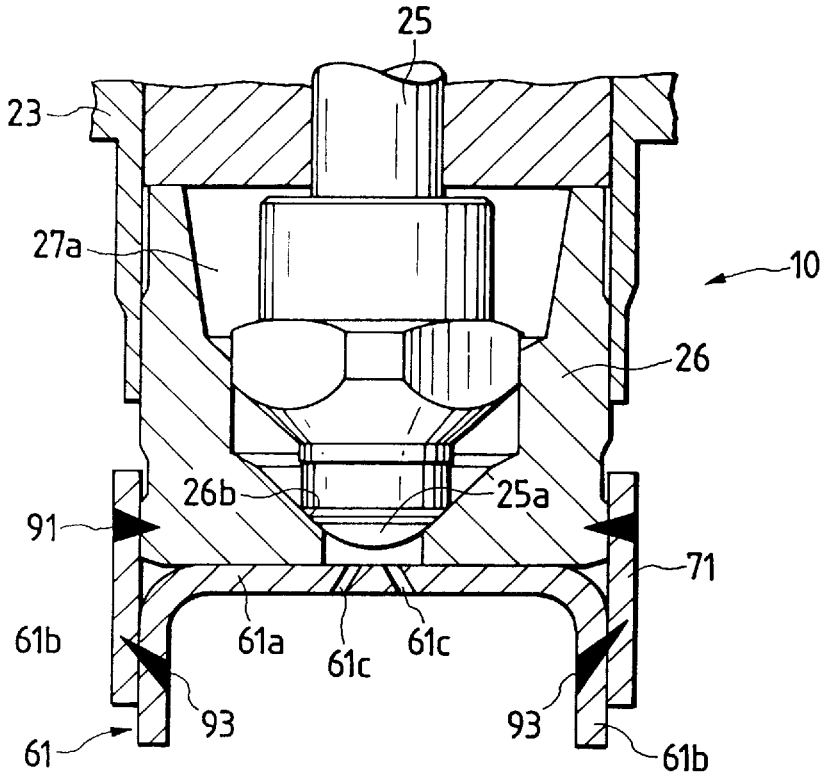
FIG. 8 is a partially enlarged view which shows a nozzle structure of a fuel injector according to the second embodiment.

FIG. 8 shows the fuel injector 10 according to the second embodiment. The same reference numbers as employed in the above first embodiment refer to the same parts.

The fuel injector 10 of this embodiment is different from that of the first embodiment only in that the nozzle body 61 is welded at a peripheral portion 93 to the sleeve 71 from the inside of the nozzle body 61. Other arrangements are identical, and explanation thereof in detail will be omitted here. This embodiment offers the same advantages as those of the first embodiment.

Figure 9:
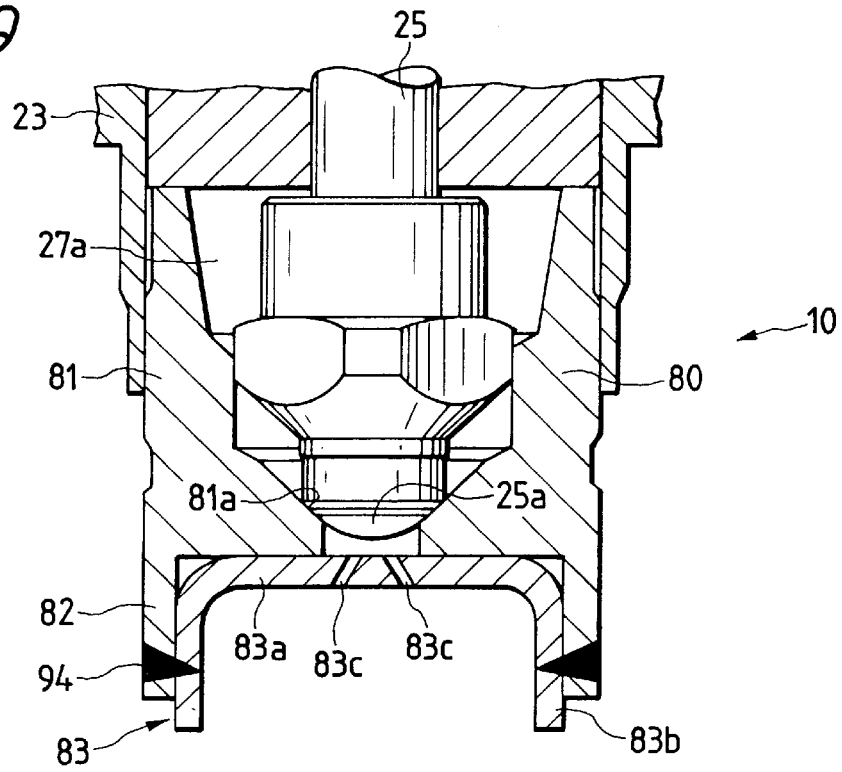
FIG. 9 is a partially enlarged view which shows a nozzle structure of a fuel injector according to the third embodiment.

FIG. 9 shows the fuel injector 10 according to the third embodiment which is different from the above embodiments in the structures of a valve body 80 and a cup-shaped nozzle body 83. Other arrangements are identical, and explanation thereof in detail will be omitted here.

The valve body 80 has formed on its end a hollow cylindrical extension 82 into which the nozzle body 83 is fitted. The nozzle body 83 is similar in shape to the nozzle body 61 of the first and second embodiments, but different therefrom in size. Specifically, the nozzle body 83 is smaller in diameter than the nozzle body 61 so that it can be press-fitted into the valve body 80. Likewise to the above embodiments, a bottom 83*a* of the nozzle body 83 having formed in a central portion thereof spray holes 83*c* is welded to an inner wall of the cylindrical extension 82 and urged against an end surface of the valve body 80 in constant engagement therewith without any clearances. This structure eliminates the use of the sleeve 71 in the first and second embodiments, thereby decreasing the number of parts which make up the fuel injector 10 and the number of production processes thereof.

Figure 10:
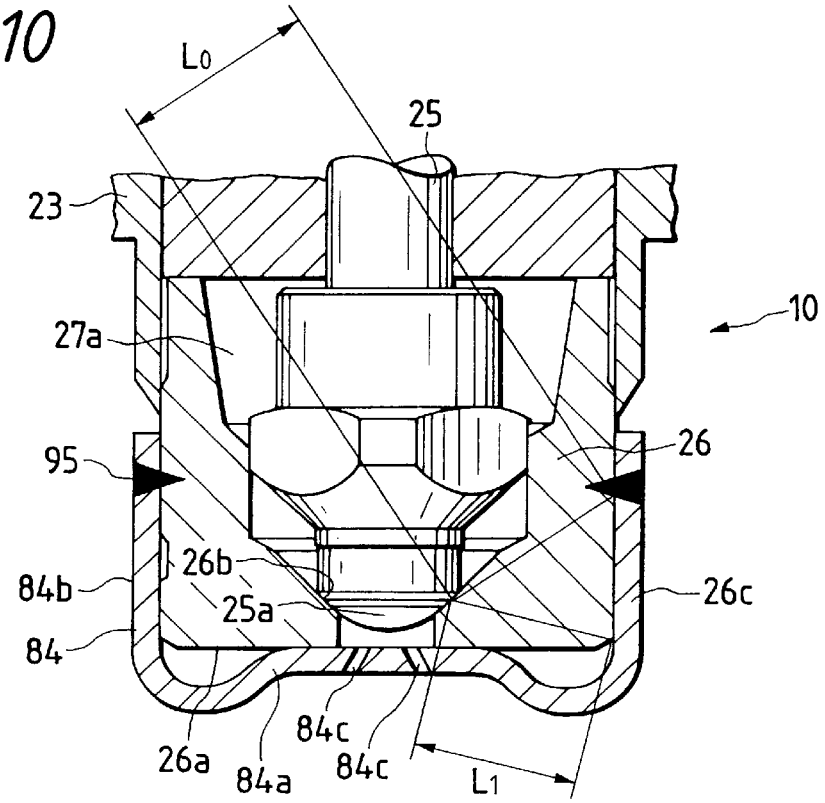
FIG. 10 is a partially enlarged view which shows a nozzle structure of a fuel injector according to the fourth embodiment.

FIG. 10 shows the fuel injector 10 according to the fourth embodiment.

The fuel injector 10 includes a cup-shaped nozzle body 84 consisting of a bottom 84*a* and a cylindrical side wall 84*b*. The bottom 84*a* has formed in its central portion a recess in which spray holes 84*c* are formed and which projects inwardly before installation on the valve body 26. The valve body 26 is press-fitted at its end portion into the nozzle body 84 with the end surface 26*a* being in constant engagement with the bottom 84*a* without any clearances. The side wall 84*b* of the nozzle body 84 is connected by laser welding to an outer surface of the valve body 26 at a portion 95 extending throughout the periphery thereof.

The length of the side wall 84*b* of the nozzle body 84 and the location of the welded portion 95 are so determined as to meet the relation of L0>L1 where L0 is the distance between the welded portion 95 and the valve seat 26*b*, and L1 is the distance between the valve seat 26*b* and the boundary between the end surface 26*a* and the side wall 26*c* (i.e., a corner of the valve body 26). The amount of heat generated when the nozzle body 84 is welded to the side wall 26*c* of the valve body 26, transmitted to the valve seat 26*b* is thus decreased as compared with when the nozzle body 84 is welded to the end surface 26*a* or the corner of the valve body 26, thereby preventing the valve seat 26*b* from being deformed thermally.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims. For example, the nozzle body 61 and the sleeve 71 may be made of a one-piece member and caulked on the valve body 26.

What is claimed is:

1. A fuel injector for an internal combustion engine comprising:

a valve body having a given length, including a fuel inlet and a fuel outlet, the fuel outlet being defined by an end surface of said valve body;

a valve member slidably disposed within said valve body, said valve member having a valve head which is selectively brought into and out of engagement with a valve seat defined by said valve body to close and open the fuel outlet;

a hollow nozzle body having a cup shape including a flat bottom and a side wall extending from the flat bottom away from said valve body, the bottom defining therein a spray hole communicating with the fuel outlet of said valve body; and a connecting member interconnecting the side wall of said hollow nozzle body to said valve body, to urge the bottom into constant engagement with the end surface of said valve body at a given level of pressure which is greater than a maximum fuel injection pressure.

2. A fuel injector as set forth in claim 1, wherein the thickness of said hollow nozzle body is 1 mm or less.

3. A fuel injector as set forth in claim 1, wherein said connecting member is welded to the side wall of said nozzle body to connect said hollow nozzle body to said valve body.

4. A fuel injector as set forth in claim 3, wherein said connecting member is made of a sleeve having one end portion welded to an outer peripheral portion of said valve body and the other end portion welded to an outer surface of the side wall of said hollow nozzle body.

5. A fuel injector as set forth in claim 1, wherein said valve body includes a hollow cylindrical extension projecting from a peripheral portion of the end surface of said valve body, wherein said connecting member is integral with said valve body, and wherein said nozzle body is fitted into the hollow cylindrical extension with a side wall of said nozzle body welded to an inner wall of the hollow cylindrical extension.

6. A fuel injector for an internal combustion engine comprising:

a valve body having a given length, including a fuel inlet and a fuel outlet, the fuel outlet being defined by an end surface of said valve body;

a valve member slidably disposed within said valve body, said valve member having a valve head which is selectively brought into and out of engagement with a valve seat defined by said valve body to close and open the fuel outlet; and a hollow nozzle body including a bottom, the bottom defining therein a spray hole communicating with the fuel outlet of said valve body, the bottom of said hollow nozzle body being elastically deformed to be flat against the end surface of said valve body, the elastic deformation of the bottom urging the bottom into constant engagement with the end surface of said valve body at a given level of pressure which is greater than a maximum fuel injection pressure.

7. A fuel injector as set forth in claim 6, wherein said nozzle body also includes a cylindrical side wall welded at an inner wall thereof to an outer peripheral wall of said valve body.

8. A fuel injector as set forth in claim 6, wherein said nozzle body is welded to said valve body so as to meet a relation of L0>L1 where L0 is a distance between the valve seat of said valve body and a location where the cylindrical side wall of said nozzle body is welded to the outer peripheral wall of said valve body and L1 is a distance between the valve seat of said valve body and a boundary between the outer peripheral wall and the end surface of said valve body.

9. A fuel injector as set forth in claim 6, wherein the bottom of said nozzle body partially projects in an inward direction in constant engagement with the end surface of said valve body.

10. A fuel injector as set forth in claim 6, wherein said hollow nozzle body has a cup shape including the flat bottom and a side wall extending from the flat bottom away from said valve body, said fuel injector further comprising a connecting member interconnecting the side wall of said hollow nozzle body to said valve body to apply a force of the elastic deformation against the end surface of said valve body.

* * * * *